United States Patent [19]

Vukich

[11] Patent Number: 4,910,372

[45] Date of Patent: Mar. 20, 1990

[54] INDUCTION BASED FOOD WARMING AND SERVING TABLE

[76] Inventor: Beth B. Vukich, 3500 W. Market St., Akron, Ohio 44313

[21] Appl. No.: 333,543

[22] Filed: Apr. 4, 1989

[51] Int. Cl.[4] ..... H05B 6/12

[52] U.S. Cl. ..... 219/10.493; 219/10.67; 219/10.75; 219/218; 312/236

[58] Field of Search ..... 219/10.491, 10.75, 10.67, 219/10.77, 218, 10.493; 312/236; 99/DIG. 14, 451

[56] References Cited

U.S. PATENT DOCUMENTS

| | | | |
|---|---|---|---|
| 2,015,295 | 9/1935 | Steingruber | 219/218 |
| 2,866,956 | 12/1958 | Miller et al. | 339/34 |
| 2,897,330 | 7/1959 | Hopkins | 219/19 |
| 3,085,142 | 4/1963 | Baermann | 219/10.49 |
| 3,617,693 | 11/1971 | Shimosawa | 219/218 |
| 3,740,513 | 6/1973 | Peters et al. | 219/10.49 |
| 3,843,857 | 10/1974 | Cummingham | 219/10.49 |
| 4,034,200 | 7/1977 | Visagie | 219/218 |
| 4,038,518 | 2/1977 | Morton et al. | 219/218 |
| 4,158,127 | 6/1979 | Husslein | 219/218 X |

*Primary Examiner*—Philip H. Leung

*Attorney, Agent, or Firm*—Fay, Sharpe, Beall, Fagan, Minnich & McKee

[57] ABSTRACT

In induction-based food warming and serving system includes a table unit adapted for receiving seating around a perimeter thereof. A top surface of the table is divided into a plurality of serving areas, displaced about the perimeter. Each serving area includes a recessed portion for receiving an induction heater/warmer module, or in the alternative, a non-functional module. Each induction heating module defines a recess, below which is placed a high-frequency induction heat coil. The recess surrounds an insulative pad, which in turn receives a serving plate comprised of iron. The table unit, and in each induction module, includes a switch for concurrently or individually controlling each heating unit.

7 Claims, 3 Drawing Sheets

INDUCTION BASED FOOD WARMING AND SERVING TABLE

BACKGROUND OF THE INVENTION

This application pertains to the art of food warming and serving tables, and more particularly to such tables which utilize induction heating properties.

The invention is particularly applicable to serving tables in home use, and will be described in particular thereto. It will be appreciated, however, that the invention has broader applications such as use in the commercial food industries.

Electrically-powered cooking ranges were initially conceived in the 1890's and first marketed around 1910. These ranges used resistive heat generation techniques. More recently, advances in ceramics and electronic controls have lead to the development and marketing of table-top electric ranges. These ranges provide for ease in cleaning given their planar construction. They are still somewhat deficient, however, given that heat generated by the resistance must still propagate to a cooking container, and then to the food place therein. This results in loss of efficiency, and is undesirable in relatively new applications. That is, it is often deemed advantageous to provide a system for maintaining warmth of food as it is consumed. Excess heat generated by resistance/radiation based warming systems provides discomfort to diners, as well as increased chances of harm by incidental contact with heating elements.

Still more recently food warming systems have adapted induction heating principles. Induction heating provides a temperature increase by exposure of a ferric, ferrous, or other iron-containing substance to a relatively high frequency alternating magnetic flux. Unlike conventional heat propagation, induction heaters rely solely upon flux linkage to provide energy for thermal activity. Accordingly, the generating device itself stays cool. Heat is only generated by any iron-containing substance placed in relatively close proximity with the generator unit.

Presently, induction-based cook ranges are commercially available. In addition, use of induction heating elements for maintaining food temperature during consumption has been acknowledged. To the extent such systems are disclosed, they are nonetheless deficient when applied to the varying needs of the typical family.

By way of example, the number of diners during a meal at any given time often varies. Expandability to accommodate additional diners is desirable. While some additions are somewhat permanent, occasionally by entertaining, and such, temporary seating locations are also needed. However, maximizing a number of seating locations for all applications results in expenses which may be unnecessary in most, if not all commonly encountered situations. A fixed seating number system also precludes adaptation to increasing household numbers, or eliminates table area which might be better utilized for purposed other than seating placement.

The present invention contemplates a new and improved induction-based food warming and serving table which overcomes all of the above-referred problems, and others, and provides a warming and serving table which is economical and adaptable.

SUMMARY OF THE INVENTION

In accordance with the present invention, there is provided an induction-based food warming includes a table unit adapted for receiving seating therearound. A horizontal top surface of the table is divided into a plurality of serving areas around the perimeter. Each serving area defines a recess which encompass a conductive coil, an insulative pad for receiving an induction heating platter, and a cover thereover.

In accordance with a more limited aspect of the present invention, the induction-based food warming system includes a means for allowing selective removal of the induction heater unit from a serving area.

In accordance with a yet more limited aspect of the present invention, there is provided a non-functioning or "dummy" unit which may be placed in the recess which receives an induction heater module.

An advantage of the present invention is the provision of an induction based serving table which limits necessary purchases of induction modules to the usual number of dinners.

Another advantage of the present invention is the provision of a means for selectively adding and removing additional modules from the food warming table as needed.

Another advantage of the present invention is found with the ability to reclaim table surface area from the induction heaters in the event that less units are necessitated by the number of dinners.

Further advantages will be apparent to one of ordinary skill in the art upon reading and understanding of the following specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
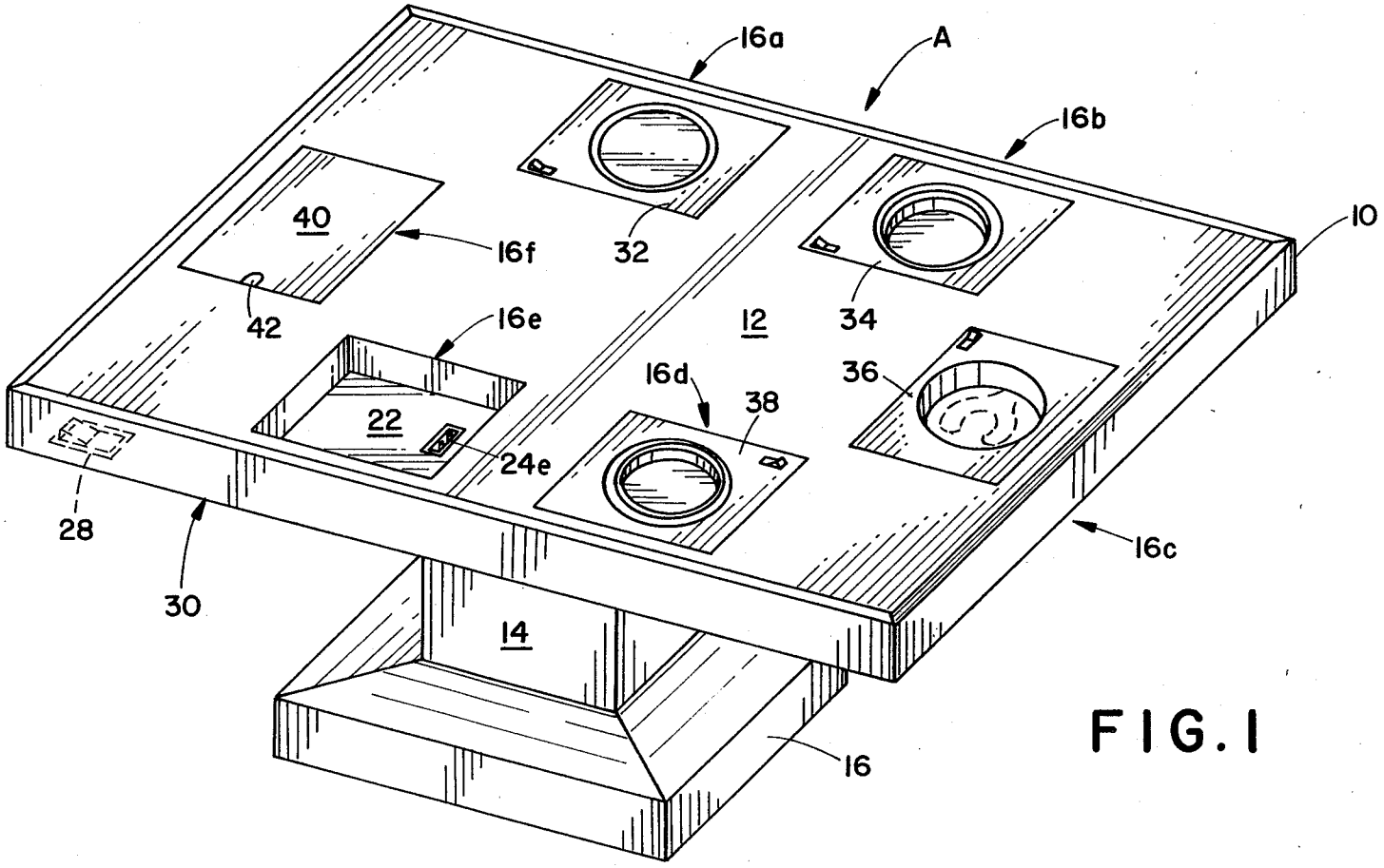
FIG. 1 illustrates a perspective view of the food serving/warming of the present invention.

Referring now to the drawings wherein the showings are for the purposes of illustrating the preferred embodiment invention only, and not for the purposes of limiting the same, a food serving/warming system is comprised of a table unit A which is adapted for receiving seating around a perimeter 10 thereof. The table unit A includes a generally horizontal top surface portion 12 around which the perimeter 10 is defined. The top surface portion 12 is supported by a support means 14 illustrated as a single table leg having a flared base portion 16.

The top surface portion 12 defines one or more seating areas 16, of which six, *16a–16f*, are illustrated. Although six such serving areas have been illustrated, it will be appreciated that fewer or more such serving areas are suitably provided in accordance with a desirable maximum number of persons to be accommodated by the system, and by physical dimensions of the top surface portion 12.

Each serving area 16 includes a means for defining a recess 22, the only visible one of which is illustrated by recessed portion 22*e* of serving area 16*e*. Each recessed portion 22 includes a means 24 for providing electricity thereto, such as illustrated as electrical connector 24*e*.

Each electrical connector 24 provides a current path to a conventional means for generating a high-frequency alternating electrical signal, which is preferably mounted within the table unit A, and suitably mounted within the support means 14 (not shown). Fabrication and functionality of such induction heating signal generators are well within the knowledge of one of ordinary skill in the art, and will not be repeated herein. Specific placement in the apparatus in conjunction with the preferred embodiment is illustrated below.

Power to the high-frequency a.c. generator means is selectively provided by switch or control means 28 which is suitably connected to a primary thereof. Specific electrical interconnections will be described with particularity below. In the preferred embodiment, the control means 28 provides an indicator to reveal that the system is in a power-on state, such as by being comprised of an illuminated switch, or the like. The control means 28 is also suitably comprised of a timer to allow for fixed or variable periods of maximum powering of the table unit A for safety and fuel economy. The control means 28 is preferably located on an underside 30 of the table unit A. Such location provides for minimizing switching by incidental switch contact, maximizing usable table surface area, and for purposes of aesthetics. Electrical power is ultimately received by an inter-connection (not shown) with a common current socket, such as one adapted to convey a 110 volt or 220 volt-house current level.

The recessed portion 22 of each serving area 16 is adapted to receive one of two basic modules. Illustrated as disposed within a recessed portion of serving area 16*a* is a first or heater module 32. Similar heater modules, 34, 36, and 38 are received in recessed portions corresponding to serving areas 16*b*, 16*c*, and 16*d*, respectively. Each heater module 32, 34, and 36 is illustrated in a varied form, the particulars of which will be discussed further below.

A recessed portion defined within the serving area 16*f* has alternatively received therein a second, non-functional blank, or "dummy" module 40. The dummy module 40 is engineered to generally the same exterior dimensions as possessed by the heater modules 32, 34, 36, and 38. Unlike the heater modules, the dummy modules, however, provide the sole function to "fill" a recessed portion to provide for further usable surface area of the top portion 12. The dummy module 40 preferably includes at least one slot or finger portion such as that illustrated at 42 to aid in removal thereof from a recessed portion in which it resides.

Figure 2:
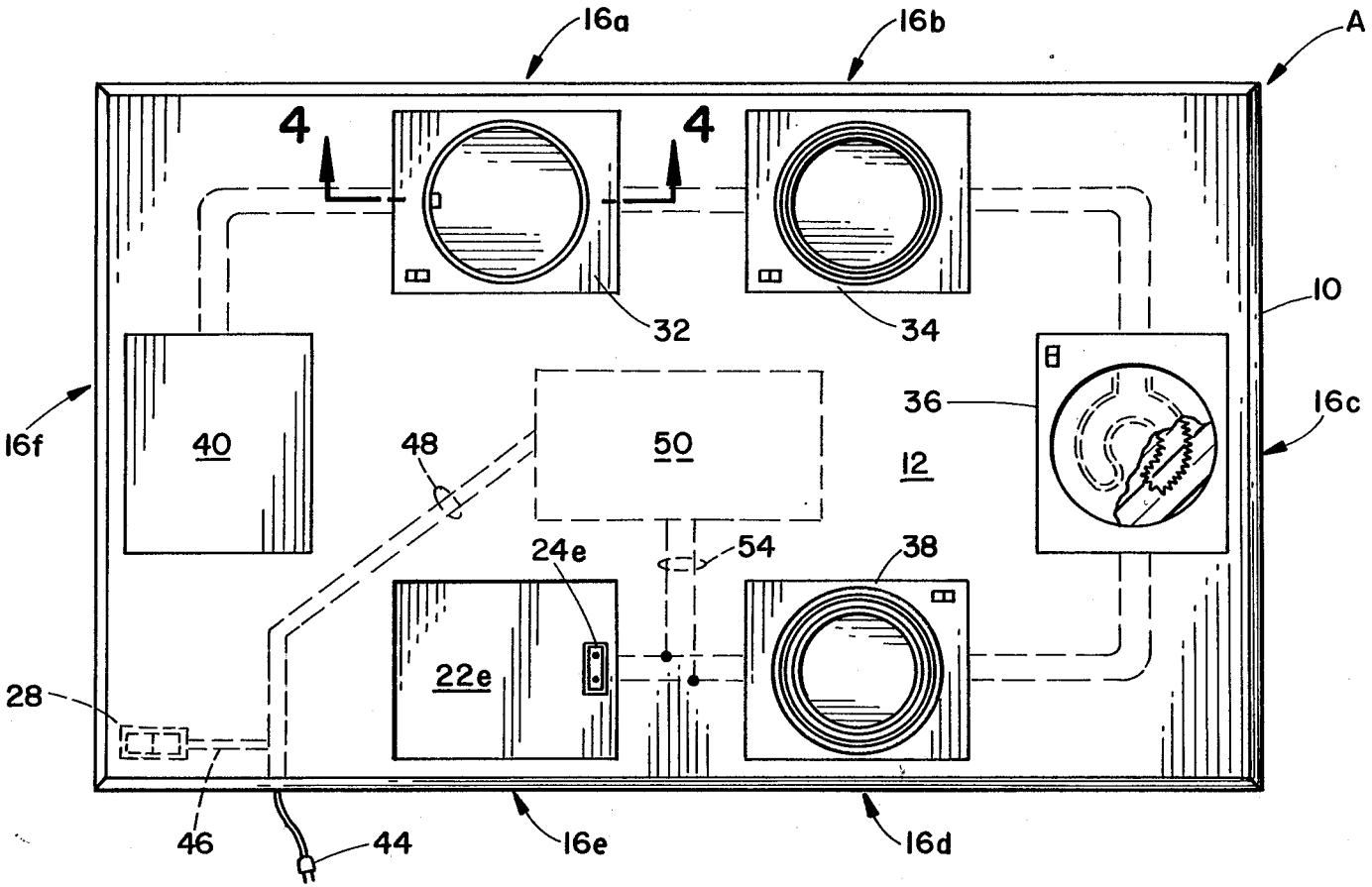
FIG. 2 represents a top plan view of the food serving/warming system of the present invention.

Turning now to FIG. 2, a top, plan view of the food warming system table unit A is provided. In addition to that disclosed in FIG. 1, FIG. 2 illustrates a male electrical connector 44 provided to receive current into the system A. An active leg of the current is sent, via conductor 46, through control means 28, as described with particularity above. Current is therefore selectively provided, via conductors 48 to high frequency a.c. generator means 50, illustrated in phantom. A high frequency a.c. signal from the means 50 is presented, in parallel, via connectors 54 to each serving area 16.

Figure 3:
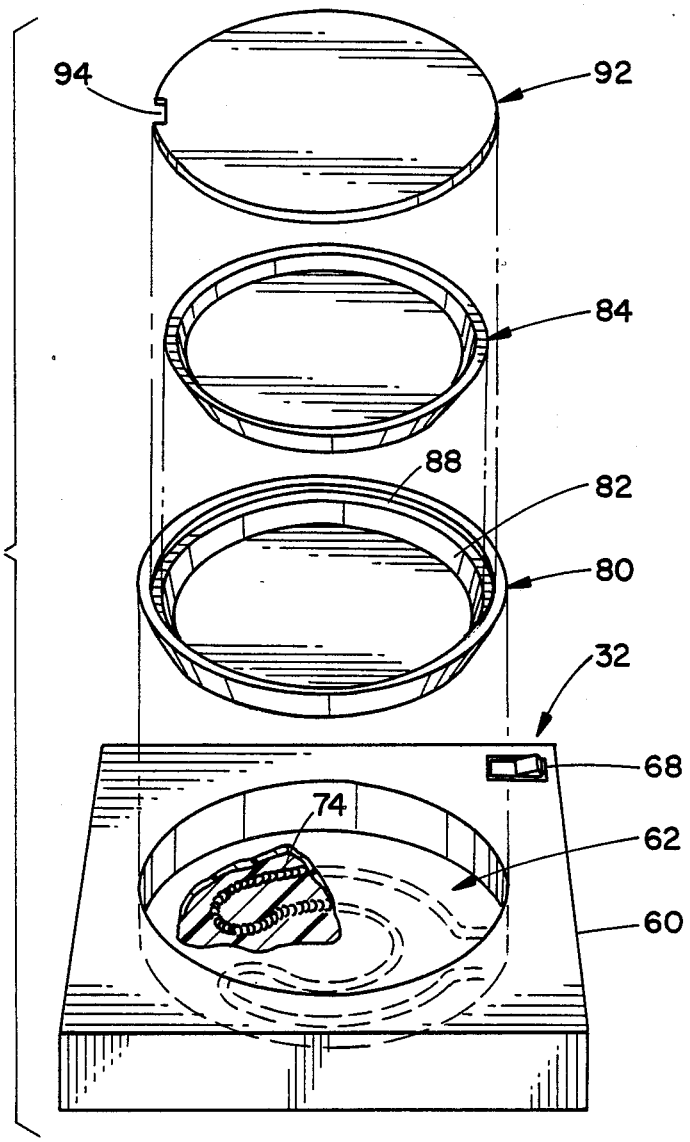
FIG. 3 illustrates a perspective, exploded view of an induction serving/warming module of FIGS. 1 and 2.

Turning now to FIG. 3, with additional reference to FIG. 4, construction of heater module 32 will be described with particularity. It will be appreciated, however, that similar construction is rendered for each heater module, such as that illustrated by modules 34, 36, and 38.

The heater module 32 includes an iron-free base portion 60 which defines a recess 62 therein. As better illustrated by FIG. 4, affixed to a bottom of base portion 60 is a projecting female electrical connector 64 adapted for matingly engaging recessed male electrical connector 24*a*. This engagement provides a current path for a high frequency a.c. signal resultant from the high frequency a.c. generator means 50.

Each heater module preferably includes, mounted on a top surface thereof, a heater module electrical switch or control means 68. The control means 68 is placed in a leg of the electrical path emanating from the female connector 64. The particular interconnections have been eliminated from the FIGURES for ease of illustration. The high frequency signal is thereby made available to a high frequency coil 74, which is mounted within the based portion 60, closely below a bottom portion 76 of the recess 62. The particular dimensions and properties of the high frequency coil 74 are well known by one of ordinary skill in the art, and will not be repeated herein. The coil 74 functions to generate rapidly alternating magnetic flux which will induce corresponding changes in magnetic flux in an iron-containing substance placed in close proximity thereto.

The recess 62 is adapted to receive, snugly therein, an iron-free insulative pad 80. The insulative pad 80, in turn defines an impressed portion 82 which is adapted to snugly receive an induction heating platter 84 therein. The insulative pad 80 further defines a shoulder or ridged portion 88 which is adapted to receive a lid or cover member 92 therein.

Figure 4:
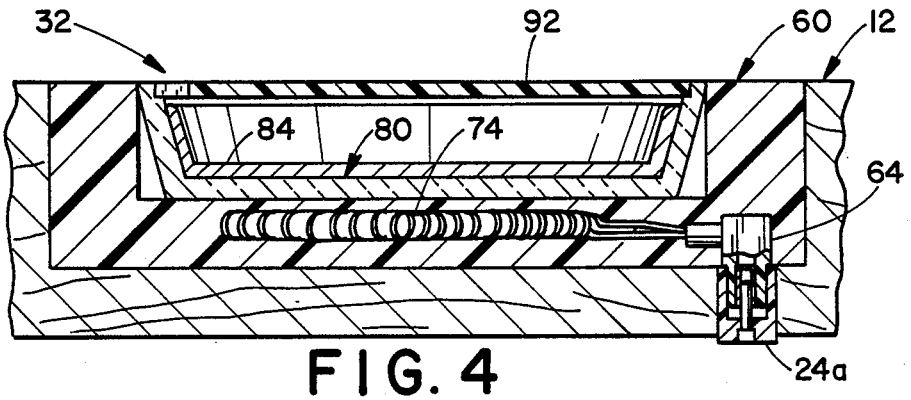
FIG. 4 illustrates a cross-sectional view of the warmer/serving unit of FIG. 3 taken along the line 4—4 of FIG. 2.

As particularly evidenced by FIG. 4, the insulative pad 80 is sized so as not to extend beyond top surface portion 12 when fitted into the recess 62. The platter 84 is sized so as to fit within the impressed portion 82, while allowing the lid or cover member 92 to rest on shoulder portion 88, while being generally flush with the top surface portion 12 of the table A.

The induction heating platter 84 is comprised of a core portion which includes an iron-containing material. Although the entire heating platter 84 may be fabricated from a uniform material, in the preferred embodiment, it is encased in a metallic sheathing (not shown). This sheathing is preferably comprised of a steel bottom portion, which portion contacts the insulative pad 80, and an iron-free substance, such as aluminum, in the top portion. In this fashion, food, which is to be warmed or maintained at a desired temperature, may be isolated from direct contact with the iron-containing core material, and the platter is protected from corrosion of the iron therein.

The lid or cover member 92 also defines a finger slot 94 which allows for easy removal of the cover portion. The cover 92 provides a means for better-maintaining food temperature within the platter 84, or for temporarily covering a heater module to provide for additional table area when the same is not in use.

Although not illustrated, additional features may easily be incorporated into the subject system. For example, it will be appreciated by one of ordinary skill in the art that varying the output of the induction-heater driver 50 will provide a means by which a heat resultant therefrom may be varied. Such a variation is suitably provided system wide, or, alternately, within the individual units. In addition, an indicator, such as a light indicator, analogous to that of control means 28, may be provided in conjunction with the heater module switch or control means 68 in each heater module unit. Such indicator provides a means by which it may be immediately ascertained whether a particular induction coil is active.

The invention has been described with reference to the preferred embodiment. Obviously, further modifications and alterations will occur to others upon the reading and understanding of this specification. It is intended that all such modifications and alterations be included insofar as they come within the scope of the appended claims or the equivalents thereof.

Having thus described my invention, I now claim:

1. A food warming system comprising:

a table unit adapted for receiving seating around a perimeter thereof;

the table unit including a generally horizontal top surface portion, the top surface portion being divided into a plurality of serving areas about the perimeter, each serving area defining an opening means for selectively matingly receiving a warmer module in the top surface portion thereof to be flushly received therein, wherein at least one of the opening means receives one of the warmer modules;

wherein each warmer modules includes, a means for defining a recess, an imperforate insulative pad received in a recess of at least one serving area, the insulative pad being sized to fit into the recess generally flush with the top surface portion of the table unit, the insulative pad defining an impressed portion in a surface thereof disposed along the top surface portion of the table unit, and a generally planar conductive coil mounted below the recess;

generator means for generating a high-frequency alternating electrical signal, mounted within the table unit;

regulator means for regulating at least one of frequency, voltage, and current of a high-frequency alternating electric signal, generated by the generator means, to a selected level, conductor means for communicating the high-frequency alternating electrical signal to the conductive coil;

socket means adapted to complete an electrically conductive path between the conductor means and the conductive coil of each warmer module disposed in an opening means;

a generally planar induction heating platter adapted for placement within the impressed portion of the insulative pad, the induction heating platter including, a core including an iron-containing material, a steel bottom portion encasing a portion of the core facing the impressed portion of insulative pad, and an iron-free heat conductive top portion encasing a portion of the core opposite the steel bottom portion.

2. The food warming system of claim 1 further comprising a plurality of generally planar covers, and wherein each of the plurality of insulative pads further defines a means for fixedly securing one of the covers such that the secondary recess defined by the respective insulative pad is covered thereby so as to be generally flush with the top surface portion of the table unit.

3. The food warning system of claim 2 further comprising at least one serving area blank, received in an opening means, having generally equivalent dimensions to dimensions of the warmer module, the serving area blank being fabricated from non-iron-containing, non-electrically conductive material.

4. The food warming system of claim 3 wherein the regulator means is contained within the warming module.

5. A food warming table comprising:

a table unit adapted for receiving seating around a perimeter thereof;

the table unit including a generally horizontal top surface portion, the top surface portion being divided into a plurality of serving areas about the perimeter, each serving area including means for alternatively, matingly receiving one of a warmer module and a serving area blank;

each warmer module including, a means for defining a recess, an imperforate insulative pad received in a recess of at least one serving area, the insulative pad being sized to fit into the recess generally flush with the top surface portion of the table unit, the insulative pad defining an impressed portion in a surface thereof disposed along the top surface portion of the table unit, and a generally planar conductive coil mounted below the recess;

male plug means for receiving electricity into the conductive coil;

each serving area blank having generally equivalent dimensions to dimensions of each warmer module, the serving area blank being fabricated from non-iron-containing, non-electrically conductive material;

generator means for generating a high-frequency alternating electrical signal, mounted within the table unit;

regulator means for regulating at least one of frequency, voltage, and current of a high-frequency alternating electrical signal, generated by the generator means, to a selected level;

female socket means, adapted for matingly engaging the male plug means in electrical contact, disposed in each of the plurality of serving areas; and conductor means for communicating the high-frequency alternating electrical signal from the generator means to the female socket means.

6. The food warming table of claim 5 further comprising a generally planar induction heating platter adapted for placement within the impressed portion of the insulative pad, the induction heating platter including, a core including an iron-containing material, a steel bottom portion encasing a portion of the core facing the impressed portion of insulative pad, and an iron-free heat conductive top portion encasing a portion of the core opposite the steel bottom portion.

7. The food warming system of claim 6 further comprising a plurality of generally planar covers, and wherein each of the plurality of insulative pads further defines a means for fixedly securing one of the covers such that the secondary recess defined by the respective insulative pad is covered thereby so as to be generally flush with the top surface portion of the table unit.

* * * * *